US009162341B2

(12) United States Patent
LeFevre et al.

(10) Patent No.: US 9,162,341 B2
(45) Date of Patent: Oct. 20, 2015

(54) CHEMICAL-MECHANICAL PLANARIZATION PAD INCLUDING PATTERNED STRUCTURAL DOMAINS

(71) Applicant: INNOPAD, INC., Wilminton, MA (US)

(72) Inventors: Paul LeFevre, Topsfield, MA (US); Anoop Mathew, Peabody, MA (US); Scott Xin Qiao, Lexington, MA (US); Guangwei Wu, Sunnyvale, CA (US); David Adam Wells, Hudson, NH (US); Oscar K. Hsu, Chelmsford, MA (US)

(73) Assignee: FNS TECH CO., LTD, Cheonan-Si (KR)

( * ) Notice: Subject to any disclaimer, the term of this patent is extended or adjusted under 35 U.S.C. 154(b) by 89 days.

(21) Appl. No.: 13/887,805

(22) Filed: May 6, 2013

(65) Prior Publication Data

US 2013/0244548 A1 Sep. 19, 2013

Related U.S. Application Data

(62) Division of application No. 12/694,593, filed on Jan. 27, 2010, now Pat. No. 8,435,099.

(60) Provisional application No. 61/147,551, filed on Jan. 27, 2009.

(51) Int. Cl.

| | |
|---|---|
| ***B24B 1/00*** | (2006.01) |
| ***B24B 37/24*** | (2012.01) |
| ***B24B 37/26*** | (2012.01) |

(52) U.S. Cl.

CPC ..... *B24B 37/24* (2013.01); *B24B 37/26* (2013.01)

(58) Field of Classification Search

CPC ..... B24B 37/24; B24D 3/28; B24D 3/285; B24D 3/344

USPC ..... 51/298; 451/526–539, 41, 59

See application file for complete search history.

(56) References Cited

U.S. PATENT DOCUMENTS

| | | | |
|---|---|---|---|
| 5,533,923 | A | 7/1996 | Shamouilian et al. |
| 5,888,121 | A | 3/1999 | Kirchner et al. |

(Continued)

FOREIGN PATENT DOCUMENTS

| | | |
|---|---|---|
| TW | 200404648 | 4/2004 |
| TW | 200810878 | 3/2008 |
| TW | 200819244 | 5/2008 |

OTHER PUBLICATIONS

Office Action from corresponding Chinese Appln. No. 201080005722.6 dated Apr. 3, 2013. English translation attached.

(Continued)

*Primary Examiner* — Dung Van Nguyen

(74) *Attorney, Agent, or Firm* — Grossman, Tucker, Perreault & Pfleger, PLLC

(57) ABSTRACT

An aspect of the present disclosure relates to a chemical mechanical planarization pad including a first domain and a second continuous domain wherein the first domain includes discrete elements regularly spaced within the second continuous domain. The pad may be formed by forming a plurality of openings for a first domain within a second continuous domain of the pad, wherein the openings are regularly spaced within the second domain, and forming the first domain within the plurality of openings in second continuous domain. In addition, the pad may be used in polishing a substrate with a polishing slurry.

5 Claims, 5 Drawing Sheets

(56) References Cited

U.S. PATENT DOCUMENTS

| | | | | |
|---|---|---|---|---|
| 6,168,508 | B1 | 1/2001 | Nagahara et al. | |
| 6,213,856 | B1 | 4/2001 | Cho et al. | |
| 6,364,749 | B1 | 4/2002 | Walker | |
| 6,544,104 | B1 * | 4/2003 | Koike et al. | 451/9 |
| 6,855,034 | B2 * | 2/2005 | Hasegawa | 451/41 |
| 6,942,549 | B2 | 9/2005 | Khoury | |
| 7,179,159 | B2 | 2/2007 | Bonner et al. | |
| 7,455,571 | B1 * | 11/2008 | Kuo et al. | 451/41 |
| 7,604,530 | B2 | 10/2009 | Shih | |
| 2003/0003857 | A1 | 1/2003 | Shimagaki et al. | |
| 2007/0015448 | A1 * | 1/2007 | Swisher et al. | 451/526 |
| 2007/0021037 | A1 | 1/2007 | Birang et al. | |
| 2007/0021045 | A1 | 1/2007 | Swisher et al. | |
| 2008/0085661 | A1 | 4/2008 | Hsu et al. | |
| 2008/0318505 | A1 | 12/2008 | Bajaj | |
| 2009/0011679 | A1 | 1/2009 | Bajaj et al. | |

OTHER PUBLICATIONS

Extended Search Report from corresponding European Application No. 10736324.4 dated Dec. 19, 2012.

Written Opinion from corresponding Singaporean Application No. 201105370-9 dated Aug. 15, 2012.

International Search Report and Written Opinion from corresponding PCT Application No. PCT/US2010/022189 dated Mar. 18, 2010.

* cited by examiner

CHEMICAL-MECHANICAL PLANARIZATION PAD INCLUDING PATTERNED STRUCTURAL DOMAINS

CROSS-REFERENCE TO RELATED APPLICATIONS

The present application is a divisional application of U.S. application Ser. No. 12/694,593, filed Jan. 27, 2010 which claims the benefit of the filing date of U.S. Provisional Application No. 61/147,551, filed on Jan. 27, 2009, the disclosures of which are incorporated herein by reference.

FIELD

The present invention relates to polishing pads useful in Chemical-Mechanical Planarization (CMP) of semiconductor wafers and other surfaces such as bare substrate silicon wafers, CRT, flat panel display screens and optical glass. In particular, the CMP pad may include one or more domains exhibiting various properties, including varying degrees of hardness.

BACKGROUND

Chemical-mechanical planarization may be understood as a process whereby a wafer or another substrate is polished to achieve a relatively high degree of planarity. The wafer may be moved relative to the chemical-mechanical planarization (CMP) pad in close proximity to each other, under pressure, and/or with a continuous or intermittent flow of abrasive containing slurry applied between them. A conditioner disk having a surface comprising relatively hard abrasive (typically diamond) particles may be used to abrade the pad surface to maintain the same pad surface roughness for consistent polish. In semiconductor wafer polishing, the advent of relatively large scale integration (VLSI) and ultra large scale integration (ULSI) circuits has resulted in the packing of many more devices in relatively smaller areas in a semiconductor substrate, necessitating greater degrees of planarity for the higher resolution lithographic processes that may be required to enable the dense packing. In addition, as copper and other relatively soft metal, metal alloys or ceramics are increasingly being used as interconnects due to relatively low resistance and/or other properties, the ability of the CMP pad to yield relatively high planarity of polish without causing scratching defects may become critical for the production of advanced semiconductors. Relatively high planarity of polish may require a relatively hard and/or rigid pad surface to reduce local compliance to the substrate surface being polished. However, a relatively hard and/or rigid pad surface may tend to also cause scratching defects on the same substrate surface thus reducing production yield of the substrate being polished.

SUMMARY

An aspect of the present disclosure relates to a chemical mechanical planarization pad. The pad may include a first domain and a second continuous domain. The first domain may include discrete elements regularly spaced within the second continuous domain. In one example, the first domain may exhibit a first hardness $H_1$ and the second domain may exhibit a second hardness $H_2$, wherein $H_1>H_2$.

Another aspect of the present disclosure relates to a method of forming a chemical mechanical planarization pad. The method may include forming a plurality of openings for a first domain within a second continuous domain of the pad, wherein the openings may be regularly spaced within the second domain. The method may also include forming the first domain within the plurality of openings in second continuous domain.

A further aspect of the present disclosure relates to a method of using a chemical mechanical planarization pad. The method may include polishing a substrate with a polishing slurry and a chemical mechanical planarization pad. The chemical mechanical planarization pad may include a first domain and a second continuous domain, wherein the first domain may include discrete elements regularly spaced within the second continuous domain.

BRIEF DESCRIPTION OF THE DRAWINGS

The above-mentioned and other features of this disclosure, and the manner of attaining them, may become more apparent and better understood by reference to the following description of embodiments described herein taken in conjunction with the accompanying drawings, wherein.

DETAILED DESCRIPTION

Figure 1:
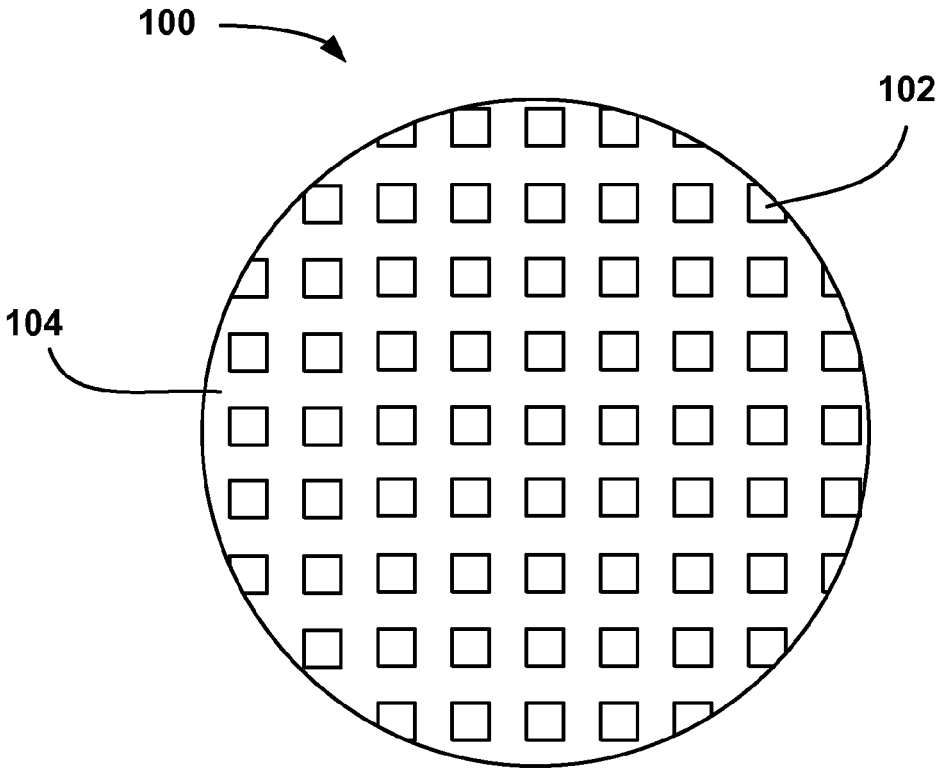
FIG. 1 illustrates an example of a CMP pad.

The present disclosure is directed to a chemical-mechanical planarization (CMP) pad that may at least partially or substantially meet or exceed various CMP performance requirements. In addition, the present disclosure relates to a product design, method of making and use of a polishing pad that may be particularly useful for the Chemical Mechanical Planarization (CMP) of semiconductor wafer substrates where a relatively high degree of planarity and low scratching defect rate may be particularly critical for the manufacture of semiconductor wafers. Furthermore, the present disclosure relates to a chemical-mechanical planarization pad that may be characterized by the inclusion of two or more segments or domains having different compositions, structures and/or properties within the same pad. Each of the domains may be designed to at least partially satisfy one or more requirements of CMP. In addition, at least one of the domains may include discrete elements present in a selected regularly repeating type geometric pattern, e.g. regularly repeating discrete domains in a continuous domain, where the discrete domains may assume the shape of a square, rectangle, circle, hexagonal, oval, tetrahedral, etc. Such discrete domains may be formed in the pad by die-cutting into a fiber substrate, and filling the die-cut regions with a selected polymeric resin. The polymeric resin may also penetrate into the non die-cut regions, with the end result, as noted, of repeating patterns of polymeric resin domains in a selected fiber domain, to thereby optimize a given polishing operation.

The regularly spaced or repeating elements of certain domains may be understood herein, in some examples, as features physically introduced into the pad (e.g. by die cutting and removing selected portions of the pad) exhibiting equal distances between a given point of each domain. The given point may be a center point, an edge point, an apex, etc. In some examples the equal distances may be exhibited in one or more dimensions of the pad. For example, longitudinally spaced elements in a domain may be spaced at first equal distance between a given point on the domain. Latitudinally spaced elements in a domain may be spaced at a second equal distance between a given point on the domain. In other examples, the domain elements may be equally spaced radially around one or more axes. Again, the radial spacing may be between the axis and a given point on each domain, such as a center point, an edge point, an apex, etc. In addition, the angular spacing of the domain elements around the axis may be from a given point on each domain, such as a center point, an edge point, an apex, etc. In addition, such regularly spaced geometrically shaped elements may be present throughout the entirety of the pad or be placed in a selected portion of the pad, including extending through a portion of a thickness of a pad and/or provided in an area of a pad surface.

The distance between a given point on each of the domain elements may be in the range of 0.127 mm to 127 mm longitudinally, including all values and increments therein. In addition, the distance between a given point on each of the domain elements may be in the range of 0.127 mm to 127 mm laterally, including all values and increments therein. Further, the distance between a given point on each of the domain elements may be in the range of 0.127 mm to 127 mm, including all values and increments therein or 1 degree to 180 degrees when spaced radially, including all values and increments therein.

As shown in FIG. 1, some examples of CMP pads 100 may include at least two domains, a first domain 102 regularly distributed within a second domain 104. It may be appreciated that the first domain may be both regularly spaced longitudinally and latidudinally across the pad surface, as illustrated. The given point may be one of the corners of the first domain or along one of the edges of the domains. In some examples, it may be appreciated that regular spacing may be in one of the longitudinal or latitudinal directions.

The first domain 102 may include a relatively hard segment including a relatively high content of hard polymeric substance exhibiting a hardness $H_1$. The hardness of the first domain may be in the range of 90 to 150 on the Rockwell R scale, including all values and increments therein. The first domain may include a polymeric material, such as polyurethane, polycarbonate, polymethylmethacrylate and polysulfone. In some examples, the regularly distributed first domain elements may have a largest linear dimension, e.g., a diameter, of 0.1 to 50% by length of the largest linear dimension, e.g., diameter, of the pad. For example, depending on the size of the features to be polished, the discontinuous domains may individually exhibit a surface area in the pad surface of 0.1 $mm^2$ to 625 $mm^2$, including all values and increments therein in 0.1 $mm^2$ increments. On an overall basis, the plurality of first domain elements (as well as any additional dispersed or distributed domains) may account for 0.1 to 90% by volume of a given pad. In addition, each of the individual domain elements may amount to 0.1 to 90% by volume of the pad. It may be appreciated that the individual domain elements may differ in the respective sizes. For example, the individual discrete domain elements may comprise a plurality of regularly distributed domain elements, such as a plurality of regularly distributed domain elements having a first surface area of "x" of 1 $mm^2$ and a plurality of regularity distributed domain elements having a surface area "y" of 2 $mm^2$ (i.e. the values of "x" and "y" are not the same).

The second domain 104 may include a relatively homogeneous, soft polymeric substance exhibiting a hardness $H_2$, wherein $H_2<H_1$, such as a relatively soft polyurethane, polyisobutyl diene, isoprene, polyamide and polyphenyl sulfide. The hardness of the second domain may be in the range of 110 or less on the Rockwell R scale, including all values and increments in the range of 40 to 110 Rockwell R or less than 95 on the Shore A durometer scale, including all values and increments in the range of 20 to 95 Shore A durometer. As can be appreciated, in FIG. 1, the second domain may be considered the continuous domain for the repeating and regularly dispersed first domain, noted above.

In some examples, the second domain may include a polymeric substance, such as those generally listed above. In other examples, the second domain may include a fibrous component such as nonwoven, woven or knitted fabric. In further examples, the second domain may include a mixture of a polymeric substance such as those named above (including one or more of a relatively hard polymeric substances and relatively soft polymeric substances) and a fibrous component such as a nonwoven, woven or knitted fabric. The fabric may include individual fibers that may or may not be soluble in aqueous or solvent based media. The fibers may include, for example, poly(vinyl alcohol), poly(acrylic acid), maleic acid, alginates, polysaccharides, poly cyclodextrins, polyester, polyamide, polyolefin, rayon, polyimide, polyphenyl sulfide, etc., including salts, copolymers derivatives and combinations thereof.

It may also be appreciated that additional domains may be present in the CMP pads as well, such as additional domains having varying degrees of hardness or polishing characteristics. The additional domains may include further repeating elements such that more than one repeating elements may be present in the polishing pad. For example, in the range of 1 and 20 different repeating patterns, including all values and increments therein may be included.

The regularly spaced domains may also exhibit differing specific gravities from that of the matrix. For example, referring to FIG. 1, the regularly spaced first domain 102 may exhibit a first specific gravity $SG_1$ of 1.0 to 2.0 and the second continuous domain 104 may exhibit a second specific gravity $SG_2$ of 0.75 to 1.5, including all values and increments therein, wherein $SG_1$ does not equal $SG_2$. It may be appreciated that the domains may exhibit various combinations of hardness and/or specific gravity, depending on the composition of each domain. For example, where a domain includes fibers embedded in a polymer matrix, the domain may exhibit a lower specific gravity than the polymer alone.

Figure 2:
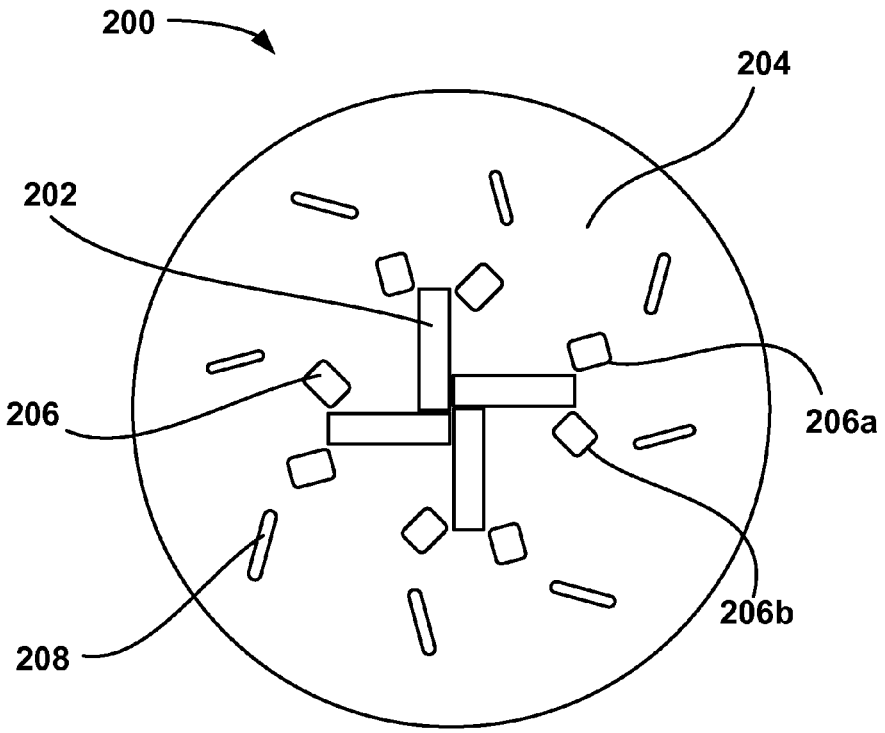
FIG. 2 illustrates another variation of an example of a CMP pad.
Figure 3:
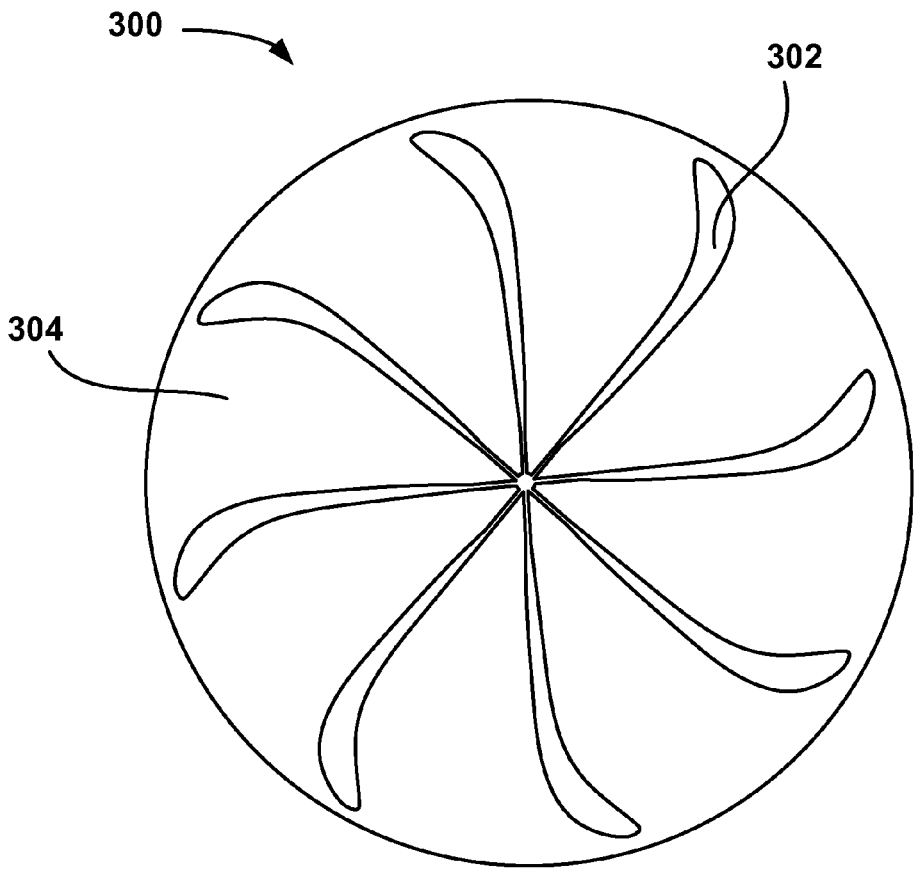
FIG. 3 illustrates yet another variation of a CMP pad.

As noted above, the number of regularly spaced domains and the configurations of the regularly spaced domains within the chemical-mechanical planarization pad may be varied. For example, FIG. 2 illustrates another variation of the above embodiment of a CMP pad 200 where a first domain 202 may be formed of rectangular elements and distributed in a pattern around a central axis in a continuum of the second domain 204. In addition, a third domain 206 and/or fourth 208 domain having different configurations may be present, also distributed in a pattern around a central axis in a continuum of the second domain. As might be appreciated, third domain 206 includes two features **206*a*, 206*b* that form repeating elements around the axis. As illustrated, each regularly spaced set of domains may be present at a different radial distance from the axis, i.e., in this example, the central point of the polishing pad. In addition, while it is illustrated that each regularly spaced set of domains may be present at an equal angular distance around the axis, it may be appreciated, that the each set of regularly spaced domains may be placed at different angular distances around the axis. It may also be appreciated that the various domains may be isolated (as illustrated) or connected. FIG. 3 illustrates yet another variation of a CMP pad 300 wherein the first domain 302 includes interconnected radial elements of extending from a central point of the pad extending to the perimeter, while the second domain 304** may include, for example, a mixture of soluble fiber and polyurethane occupying the remaining pad continuum of the pad.

Accordingly, it may be appreciated that various regularly repeating domains, each having a different set of compositions, properties and/or CMP performance, may be incorporated in a given pad. Furthermore, the physical shape, dimensions, location, and directional orientation throughout the pad may have a number of variations, while still being regularly spaced. In addition, it may be appreciated that in some examples, the CMP pad itself may exhibit varying geometries even though the CMP pads illustrated herein are relatively circular. Thus, the ability to incorporate a multitude of regularly spaced domains having different design features may enable a CMP pad to satisfy at least a portion or all of or even exceed the CMP performance requirements as mentioned above.

Some examples of variations of CMP pads may include a first domain of polyurethane with hardness rating from 30 to 90 Shore D. The first domain may be present in the pad as discrete, disconnected squares dispersed in the second domain. The second domain may include a mixture of a nonwoven fabric made of water soluble fibers embedded in the same polyurethane used in the first domain. In other variations, the CMP pad may include a first domain of polyurethane exhibiting a specific gravity of 1.25 and a second domain including fiber embedded within polyurethane having a specific gravity of 0.8. In further examples, the CMP pad may include a first domain of a polyurethane exhibiting a hardness of 50 on the Shore D durometer scale and a specific gravity of 1.25, a second domain exhibiting a hardness of 75 on the Shore D durometer scale and a specific gravity of 0.25 and a third domain of embedded fiber in a polyurethane exhibiting a hardness of 75 on the Shore D durometer scale and a specific gravity of 0.8.

Figure 4:
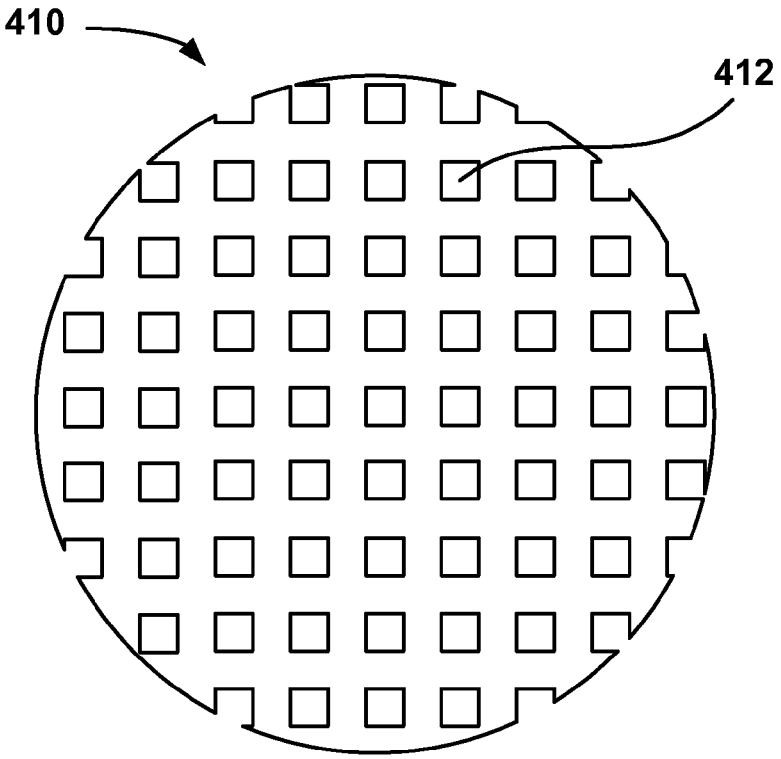
FIG. 4 illustrates an example of a die cut fabric for forming a CMP pad.

The CMP pads contemplated herein may be formed by die-cutting openings or recesses of regular elements of the first domain in the nonwoven fabric using a template to achieve relative uniformity and distribution of square holes through the fabric. Reference to a recess may be understood as a void that does not extend completely through the thickness of the pad. As may be appreciated, the openings may be regularly spaced in the second domain to provide for the regularly spaced discrete elements of the first domain. FIG. 4 illustrates an example of a die cut fabric 410 including a number of openings or recesses 412 formed therein by the die cutting process. It may be appreciated that, in addition to die cutting, similar processes may be utilized in forming the various geometrical configurations that may be contemplated in providing the various regularly spaced domains, such processes may include laser cutting, blade cutting, water jet cutting, etc.

The fabric may then be placed in the cavity of a lower (female) mold. A polymer or polymer-precursor may then be added to the mold. For example, a mixture of unreacted polyurethane pre-polymer and curative may be dispensed on the fabric. The upper (male) mold may then be lowered into the cavity of the lower mold, thus pressing the said mixture to fill the interstices of the fabric and/or the die cut regions. Heat and/or pressure may then be applied, which may effect flow of the polymer or reaction and/or solidification of the pre-polymer with the embedded fabric into a flat pad, followed by curing and annealing of the solidified pad in an oven. It is therefore important to point out that by such procedure, the majority (e.g. ≥75% by weight) of the polymer or polymer precursor introduced into the die cut regions remains in the die cut region, and the remainder may diffuse into the second domain of the selected pad. In addition, by such procedure, such diffusing may only occur in the upper portion of the selected pad, such as, e.g., only within the upper 50% of the thickness of a given pad.

In some examples, a relatively softer polymer, such as a polymer have properties similar to a fabric, including, for example, foam or a sheet material, may also be die cut or cut via other processes, such as laser cutting, water jets, hot knife, wire, etc., as well, to form the various geometrical configurations of the second or continuous. The relatively harder polymer of the first domain may then be over molded/or molded into the relatively softer polymer of the second domain. In some examples, overmolding may be provided by injection molding a composition forming the first domain over the second domain.

Furthermore, the squares or geometric features of the regularly spaced domain, including a relatively hard polymer, may be advantageous in polishing features where a high degree of planarity may be important or critical, as the relatively harder polymer may present a relatively more rigid, thus less compliant surface to the substrate being polished. The soluble fiber of the second domain or relatively softer polymer may be dissolved or abraded and/or removed from the pad prior to, or during, CMP. The removed fibers or relatively softer polymer may create a network of voids or pores within the second domain. Such voids, in combination with a regular pattern of hard domains, may then provide more efficient CMP polishing.

The polishing pad may also include voids or pores. The presence of voids or pores within the second domain in a given pad may be a factor for relatively high polish rates and low scratching defects, since the presence of pores may facilitate movement of the abrasive slurry within the micro locales of the pad to enhance and control the contact between the abrasive particles and the wafer surface being polished. The voids or pores may also act as micro reservoirs for relatively large agglomerates of abrasive particles and polish by-products, thus avoiding relatively hard contact and scratching of the wafer surface. The voids or pores may have a largest linear dimension of 10 nanometers to over 100 micrometers, including all values and increments in the range of 10 nanometers to 200 micrometers, 10 nanometers to 100 nanometers, 1 micrometer to 100 micrometers, etc. Furthermore, in some examples, the voids or pores may have cross sectional area of 1 square nanometer to 100 square nanometers, including all values and increments therein.

Non-uniformity within the wafer or other substrate to be polished may also benefit from the placement, spatial orientation and/or distribution of the domains in relation to the wafer track during polish, such that the relatively slower polish areas of the substrate may be exposed preferentially to the domain including a relatively softer material, and the relatively faster polish areas of the substrate may be exposed preferentially to the relatively harder material of the first domain. There may be numerous domain design combinations suited to different CMP applications, such that a custom pad having different domains each having its own characteristic physical, chemical properties, size, shape, spatial orientation, areal ratio to other domains and distribution.

Figure 5:
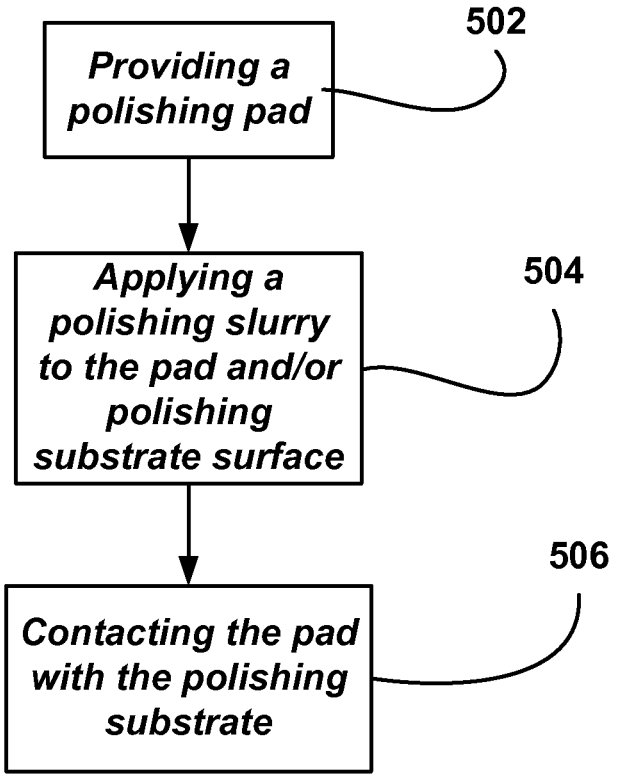
FIG. 5 illustrates an example of a method of using a CMP pad described herein.

Also contemplated herein is an example of a method of using a polishing pad for Chemical Mechanical Planarization (CMP) of a substrate surface, as illustrated in FIG. 5. The substrate may include microelectronic devices and semiconductor wafers, including relatively soft materials, such as metals, metal alloys, ceramics or glass. In particular, the materials to be polished may exhibit a third hardness $H_3$, having a Rockwell (Rc) B hardness of less than 100, including all values and increments in the range of 0 to 100 Rc B as measured by ASTM E18-07. Other substrates to which the polishing pad may be applied may include, for example, optical glass, cathode ray tubes, flat panel display screens, etc., in which, scratching or abrasion of the surface may be desirably avoided. A pad may be provided as described herein may be provided 502. The pad may then be utilized in combination with polishing slurry such as a liquid media, e.g., an aqueous media, with or without abrasive particles. For example, the liquid media may be applied to a surface of the pad and/or the substrate to be polished 504. The pad may then be brought into close proximity of the substrate and then applied to the substrate during polishing 506. It may be appreciated that the pad may be attached to equipment used for Chemical Mechanical Planarization for polishing.

Performance criteria or relatively desirable requirements of CMP pads may include, but are not limited to the following. A first criterion may include a relatively high polish or removal rate of the wafer surface, measured in for example Angstrom/min. Another criterion may include a relatively low within wafer non-uniformity, measured as the post polish thickness standard deviation expressed as a percentage of the average thickness, over the entire wafer surface. Yet another criterion may include relatively high degree of after polish planarity of the wafer surface. In the case of metal polish, the planarity is expressed in terms of 'dishing' and 'erosion'. 'Dishing' may be understood as the over polish of metal wiring beyond the dielectric insulation substrate. Excessive 'dishing' may lead to loss in electrical conductivity within the circuitry. 'Erosion' may be understood as the extent of over polish of the dielectric insulation substrate where the circuitry is embedded. Excessive 'erosion' may result in the lost of depth of focus in the lithographic deposition of metal and dielectric films on the wafer substrate. A further criterion may include a relatively low defect rate, in particular scratching of the wafer surface during polish. Yet a further criterion may include relatively long, uninterrupted polish cycles between changeovers of pad, abrasive slurry and conditioner. It may be appreciated that a given pad may exhibit one or more of the criteria described above.

The foregoing description of several methods and embodiments has been presented for purposes of illustration. It is not intended to be exhaustive or to limit the disclosure to the precise steps and/or forms disclosed, and obviously many modifications and variations are possible in light of the above teaching.

What is claimed is:

1. A method of forming a chemical mechanical planarization pad, comprising:

forming a plurality of openings for a first domain within a second continuous domain of said pad, wherein said openings are regularly spaced within said second domain; and forming said first domain within said plurality of openings in second continuous domain;

wherein said second continuous domain comprises a fabric having a plurality of interstices, and wherein the method further comprises providing a polymer precursor and said polymer precursor flows into said plurality of interstices and said plurality of openings forming said first domain.

2. The method of claim 1, wherein said plurality of openings for said first domain are die-cut.

3. The method of claim 1, further comprising adding said first domain to said second domain as a polymer precursor and solidifying said polymer precursor to form said first domain.

4. The method of claim 3, wherein said second domain is positioned in a mold; said polymer precursor is added to said mold; and heat and/or pressure is applied to said mold to solidify said polymer precursor.

5. The method of claim 1, further comprising forming said first domain by overmolding said second domain with a composition forming said first domain.

* * * * *